US005143125A

United States Patent [19]

Tamatani et al.

[11] Patent Number: 5,143,125

[45] Date of Patent: Sep. 1, 1992

[54] TRANSFER TAIL FORMING APPARATUS FOR WEFT FEEDERS

[75] Inventors: Yasuyuki Tamatani; Kanji Tsuji, both of Kanazawa, Japan

[73] Assignee: Tsudakoma Kogyo Kabushiki Kaisha, Kanazawa, Japan

[21] Appl. No.: 591,835

[22] Filed: Oct. 2, 1990

[30] Foreign Application Priority Data

Oct. 4, 1989 [JP] Japan ..... 1-259695
Jan. 26, 1990 [JP] Japan ..... 2-17582

[51] Int. Cl.[5] ..... D03D 47/34

[52] U.S. Cl. ..... 139/450; 242/131

[58] Field of Search ..... 242/35.6 R, 131, 131.1, 242/35.5 A; 57/279; 139/450, 452; 28/208, 209, 211; 289/2, 13; 66/133, 134, 141, 125 R

[56] References Cited

U.S. PATENT DOCUMENTS 4,105,228 8/1978 Messa .
4,361,003 11/1982 Bertoli .
4,658,866 4/1987 Takegawa ..... 139/450
4,856,691 8/1989 Takehana et al. ..... 139/450
4,887,649 12/1989 van Mullekom ..... 139/450

FOREIGN PATENT DOCUMENTS 0171057 2/1986 European Pat. Off. .
0284590 9/1988 European Pat. Off. .
0298025 1/1989 European Pat. Off. .
61-47849 3/1986 Japan .
960856 6/1964 United Kingdom ..... 242/131
8801659 3/1988 World Int. Prop. O. .

*Primary Examiner*—Andrew M. Falik
*Attorney, Agent, or Firm*—Oblon, Spivak, McClelland, Maier & Neustadt

[57] ABSTRACT

A transfer tail forming apparatus for weft feeders fed to a weaving machine, wherein a tail end of a feeder now in use and a leading end of a preliminary feeder are connected together using a knotter. The tail end and the leading end are automatically positioned and held in a predetermined position by a positioning apparatus, and the yarn ends are connected together by the knotter to form a transfer tail. Further, by the provision of a stand-by apparatus the transfer tail is held in a predetermined posture, and when the whole quantity of the weft on the feeder now in use has been consumed, the leading end of the preliminary feeder can be introduced into the weaving machine in a continuous manner. Moreover, when the supply of weft from the feeder now in use is discontinued, the introduction of the leading end from the preliminary feeder is made possible by the stand-by apparatus. Additionally, by combining with the apparatus a conveyance cassette having a yarn end fixing member at the time of conveyance of a feeder to a feeder stand, the leading end and tail end of the feeder can be held automatically for the above positioning apparatus.

24 Claims, 7 Drawing Sheets

TRANSFER TAIL FORMING APPARATUS FOR WEFT FEEDERS

BACKGROUND ART

1. Field of the Invention

The present invention relates to a transfer tail forming apparatus for weft feeders which forms a transfer tail automatically by connecting a tail end of a weft feeder now in use with a leading end of a preliminary weft feeder to be used next, for the purpose of changing feeders for the supply of weft to a weaving machine from one to another.

2. Description of the Related Art

In a shuttle-free weaving machine including a jet loom, weft is fed from a weft feeder (hereinafter referred to simply as "feeder") mounted on a feeder stand. When the whole quantity of weft on a single feeder has been consumed, it is necessary to replace the feeder with a new one. As a technique for omitting the weaving machine suspension time during the said replacement there is widely used an automatic feeder change-over technique using a so-called transfer tail.

If a winding start end (hereinafter referred to as "tail end") of a feeder which is supplying weft (hereinafter referred to as "feeder now in use") is connected with a winding terminal end (hereinafter referred to as "leading end") of a feeder to be used next ("preliminary feeder", hereinafter) which is disposed in parallel with the feeder now in use, and thus both yarn ends are connected together through a socalled transfer tail, the weft source will automatically shift to the preliminary feeder when the whole quantity of weft on the feeder now in use has been consumed. Consequently, it is possible to completely omit the suspension of a weaving machine caused by the replacement of feeders. The remaining empty bobbin after the consumption of the total quantity of weft is replaced with another new feeder until the feeder which has newly come to be used as the feeder now in use is consumed in the whole quantity, and this another new feeder is used as a preliminary feeder, with a transfer tail formed between it and the feeder now in use in the same manner as above.

In changing feeders from one to another using such transfer tail, it is more convenient to use an automatic weft threading apparatus (see, for example, Japanese Patent Laid Open No. 47849/986). The technique disclosed therein is for coping with the case where weft fed from a feeder now in use has broken in an intermediate stage of consumption of the feeder. According to the said technique, an automatic threading apparatus is moved from a weaving machine side closer to a transfer tail which has been positioned and held in a predetermined position, and the feeder now in use-side of the transfer tail is cut. In this construction, a leading end of a preliminary feeder is subjected to threading automatically up to a weft measuring and storing apparatus of the weaving machine. As a result, even when the supply of weft stops upon breakage of the weft from the feeder now in use, the weaving machine can continue the operation smoothly under the supply of weft from the preliminary feeder upon completion of the operation of the automatic threading apparatus.

According to such prior art, since the change-over from the feeder now in use to the preliminary feeder is performed without suspension of the operation of the weaving machine, so it is possible to improve the operating efficiency of the weaving machine. In many cases, however, the transfer tail is formed by manual operation of a weaver, so the problem that the weaver's work in the feeder replacement becomes excessive has so far been unavoidable. On the other hand, leading and tail ends of feeders used for forming the transfer tail are suspended free from the feeders and in this state the feeders are conveyed to feeder stands, so there remains an unnecessary work required for the operator also in taking out the leading end from the preliminary feeder.

For the above reason, in the case of planning an automation system for the operations of conveyance and replacement of feeders in a factory, it has been strongly desired to also automate the transfer tail forming operation. But no technique capable of meeting this demand has been known.

SUMMARY OF THE INVENTION

It is the first object of the present invention to provide a transfer tail forming apparatus for weft feeders capable of automatically positioning a tail end of a feeder now in use and a leading end of a preliminary feed to a predetermined position, then connecting both together and feeding the thus-formed transfer tail smoothly to a weaving machine.

It is the second object of the present invention to permit automatic supply of weft from a preliminary feeder when the supply of weft from a feeder now in use has been discontinued halfway by some cause or other.

It is a further object of the present invention to provide a feeder conveying cassette capable of drawing out a yarn end smoothly from a feeder and also provide a transfer tail forming apparatus for weft feeders capable of automatically taking out a yarn end from a feeder fed to a feeder stand and positioning it.

DESCRIPTION OF THE PREFERRED EMBODIMENTS

Embodiments of the present invention will be described hereinunder with reference to the accompanying drawings.

Figure 1:
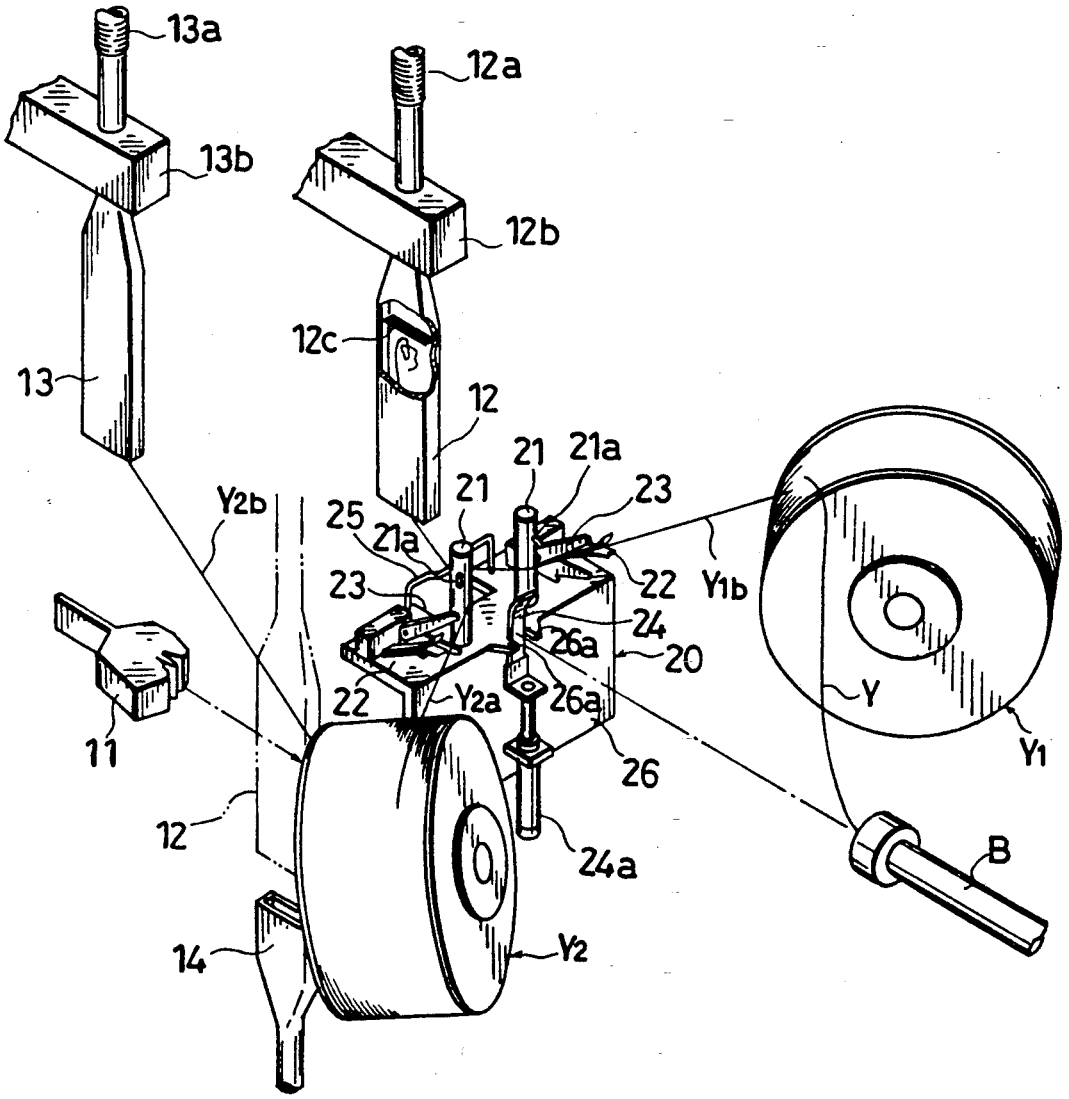
FIG. 1 is an explanatory perspective view showing an entire construction of a transfer tail forming apparatus according to an embodiment of the present invention.

A transfer tail forming apparatus for weft feeders according to an embodiment of the present invention consists principally of a knotter 11, yarn end carriers 12, 13, a yarn holder 14 and yarn guides 21, 21, as shown in FIG. 1. The yarn guides 21, 21 are mounted to a base member 26 together with clampers 22, 22, cutters 23, 23, a stopper spring 24 and a guide member 25 to constitute a guide unit 20.

The guide unit 20 is disposed in opposed relation to a guide member B of an automatic threading apparatus attached to a weaving machine (not shown). On both sides of the guide unit 20 there are disposed a feeder now in use $Y_1$ and a preliminary feeder $Y_2$ mounted on feeder stands YS, YS (see FIG. 2). The posture of the feeder now in use $Y_1$ and that of the preliminary feeder $Y_2$ mounted on the feeder stands YS, YS can be changed over between an operating posture in which they are obliquely opposed to the guide member B and an upwards replacement posture.

While the weaving machine is in normal operation, the guide member B serves as a guide pipe for conducting weft Y from the feeder now in use $Y_1$ to a weft measuring and storing apparatus of the weaving machine. On the other hand, in the event of breakage of the weft Y, the guide member B advances up to a position (a dash-double dot line position B' in FIG. 3) in which it is almost in contact with the guide unit 20 and so it can suck in a transfer tail Yt which is standing by on the guide unit 20.

The knotter 11 is disposed behind the guide unit 20 so that it can be moved forward and backward between a stand-by position (the solid line position in FIG. 4) and an operating position (the dash-double dot line position in FIG. 4) by means of a drive source (not shown). In the operating position the knotter receives a knotter driving signal and knots two yarns together which are inserted vertically into slits 11*a* and 11*b* formed in the front end portion of the knotter. Further, it is required that the yarn portions below the knotted point be cut by means of a cutter incorporated in the knotter.

The yarn end carriers 12 and 13 are downwardly facing suction nozzles which are connected to a suction source (not shown) through flexible hoses 12*a* and 13*a*, as shown in FIG. 1. They can suck in a leading end $Y_{2a}$ and a tail end $Y_{2b}$ of the preliminary feeder $Y_2$ from openings formed in the respective lower ends, and hold them. The yarn end carriers 12 and 13 are connected respectively to robot devices (not shown) through support members 12*b* and 13*b* so that they can move longitudinally, transversely and vertically each independently. In the interior of the yarn end carrier 12 is incorporated a net 12*c*, whereby the leading end $Y_{2a}$ which has been sucked in is held in a bent state under the net 12*c*. Also, this is quite true of the yarn end carrier 13. However, the net 12*c* is not always necessary if only the leading end $Y_{2a}$ which has been sucked in can be drawn out smoothly.

The yarn holder 14, which is an upward suction nozzle, is disposed behind the guide unit 20 and below the knotter 11.

The yarn guides 21, 21 of the guide unit 20 are erected right and left on the upper surface of the base member 26, and outside the yarn guides 21, 21 there are disposed the cutters 23, 23 and the clampers 22, 22 in a symmetric form. Nozzle tips 21*a*, 21*a* for jetting air in a downward direction along the front face of the base member 26 are attached to the yarn guides 21, 21 in intermediate positions. The spacing between the yarn guides 21 and 21 is set at a distance which permits the yarn end carriers to pass therethrough back and forth.

The cutters 23, 23 can be operated by means of a drive source (not shown), and the clampers 22, 22 are conventional yarn clamping mechanisms utilizing a spring action and having front end portions which are open obliquely.

The stopper spring 24 is a plate spring having an upper end portion which is bent forwards, and it can be moved vertically by a cylinder 24*a* of a small stroke. The stopper spring 24, in a raised position thereof, projects higher than the base member 26 (see FIGS. 1 and 4) and engages the transfer tail Yt, while in a lowered position thereof the stopper spring is disengaged from the transfer tail Yt. The stopper spring 24 is disposed on the front face of the base member 26 so as to be inserted between lugs 26*a* and 26*a* projecting forwards from the upper surface of the base member 26.

The guide member 25 is mounted so as to span a cutout portion 26*b* formed behind the yarn guides 21, 21, and the central portion thereof is curved downwards.

The operation of the above apparatus will be described below with reference to FIGS. 2 to 4.

It is here assumed that the feeder on one feeder stand is used as a feeder now in use $Y_1$ and that the other feeder stand YS is in its upward replacement posture and a new preliminary feeder $Y_2$ has been mounted thereon. It is also assumed that a tail end $Y_{1b}$ of the feeder now in use $Y_1$ has passed the clamper 22 and cutter 23 located on the side closer to the feeder $Y_1$, further passed between the guides 21 and 21 from the front side to the rear side and has been sucked into the yarn holder 14. The yarn end carriers 12 and 13 are in stand-by positions close to the preliminary feeder $Y_2$ indicated by a solid line in FIG. 2. In this case, it is further assumed that the height of the yarn end carriers 12 and 13 has been adjusted so that the lower end portions thereof can pass between the yarn guides 21 and 21 without interference with the stopper spring 24 which is in its raised position.

After mounting of the preliminary feeder $Y_2$ onto the feeder stand YS, its leading end $Y_{2a}$ and tail end $Y_{2b}$ are allowed to be sucked in by the yarn end carriers 12 and 13 and are held in the foregoing stand-by positions, whereby the leading end $Y_{2a}$ and the tail end $Y_{2b}$ are tightened rectilinearly under a predetermined tension according to the suction force of the yarn end carriers 12 and 13.

Figure 2:
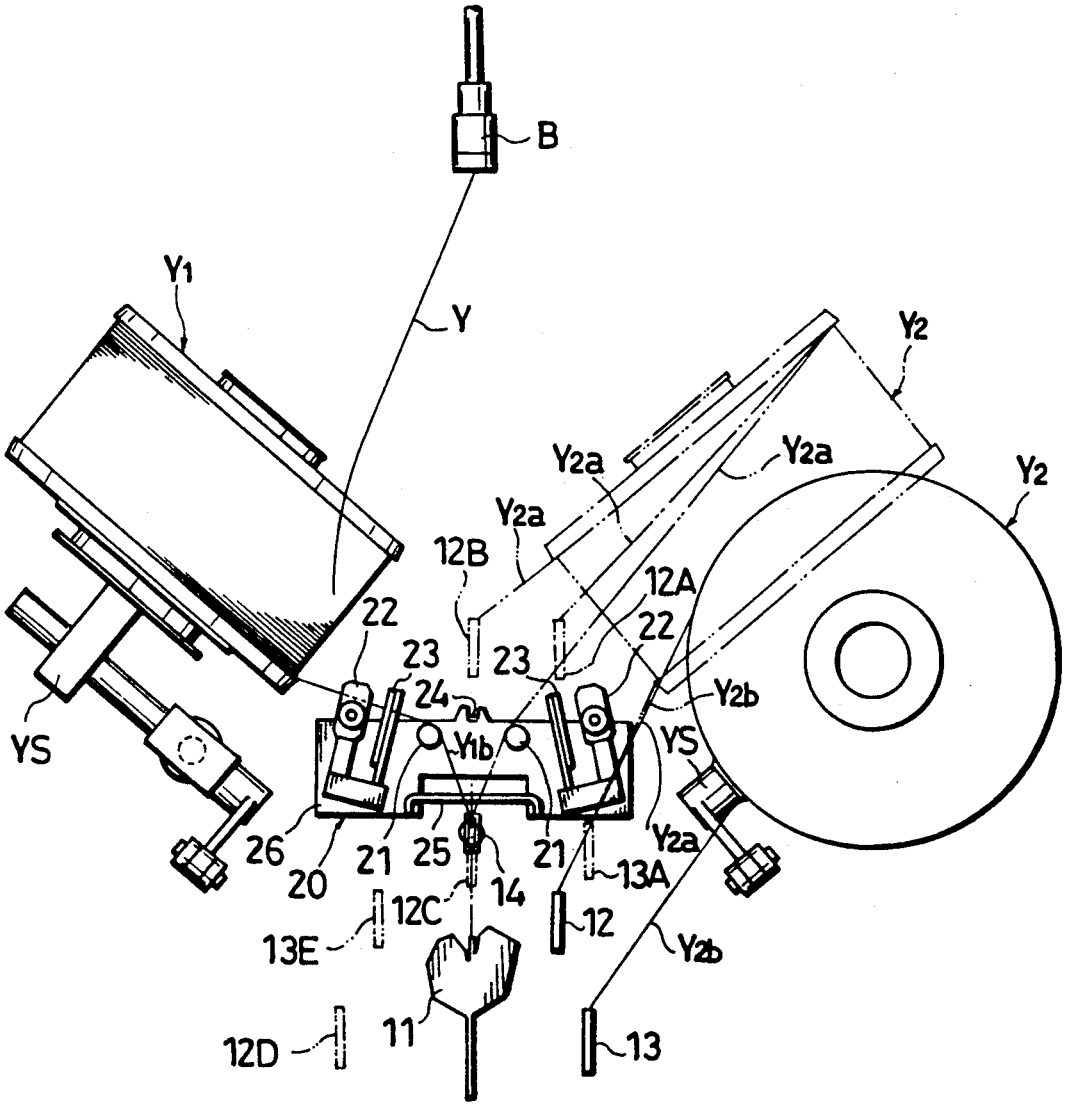
FIGS. 2 and 3 are views explanatory of operation in the embodiment of FIG. 1.

Then the preliminary feeder $Y_2$ is brought down to its operating posture, as indicated by a chain line in FIG. 2, whereupon the yarn end carrier 13 associated with the tail end $Y_{2b}$ advances up to a position 13A just behind the guide unit 20 and stops, while the yarn end carrier 12 associated with the leading end $Y_{2a}$ gets over the guide unit 20 and advances up to a front position 12A. At this time, the distances of the yarn end carriers 12 and 13 relative to the preliminary feeder $Y_2$ vary, but this variation is compensated for by going in and out of the leading end $Y_{2a}$ and tail end $Y_{2b}$ which have been sucked in a bent state into the carriers 12 and 13, whereby the leading end $Y_{2a}$ and the tail end $Y_{2b}$ can held in a tightened state always under approximately constant tension irrespective of the movements of the yarn end carriers 12 and 13.

Then, the yarn end carrier 12 moves to a position 12B just in front of the guide unit 20, further moves between the yarn guides 21 and 21 up to a position 12C behind the yarn guides, and moves horizontally to a position in which its front portion which holds the leading end $Y_{2a}$ overlaps the space above the yarn holder 14, then moves down until it comes sufficiently close to the yarn holder 14.

If in this state the suction of the yarn end carrier 12 is stopped and that of the yarn holder 14 is started, the leading end $Y_{2a}$ which has been conveyed by the yarn end carrier 12 transfers from the yarn end carrier 12 to the yarn holder 14. Consequently, as shown in FIG. 4, the leading end $Y_{2a}$ can be positioned in a certain shape among the yarn guide 21, guide member 25 and yarn holder 14 which are located on the side close to the preliminary feeder $Y_2$. The suction force of the yarn holder 14 can be suitably adjusted by a throttle valve (not shown) or the like.

At this time, the tail end $Y_{1b}$ of the feeder now in use $Y_1$ has already been positioned among the other yarn guide 21, guide member 25 and yarn holder 14, so the tail end $Y_{1b}$ and the leading end $Y_{2a}$ are arranged symmetrically in the operating position of the knotter 11.

The yarn end carrier 12 is retracted to a stand-by position 12D (a position symmetric with the initial position of the yarn end carrier 13) in preparation for the yarn end processing operation for a new preliminary feeder to be next loaded in the position of the feeder now in use $Y_1$. Subsequently, by advancing and operating the knotter 11 as indicated by a dash-double dot line in FIG. 4 the tail end $Y_{1b}$ and the leading end $Y_{2a}$ are connected together to form a transfer tail Yt between the feeder now in use $Y_1$ and the preliminary feeder $Y_2$.

Since the knotter 11 not only knots the tail end $Y_{1b}$ and the leading end $Y_{2a}$ together but also cuts the yarn portions below the knotted part, surplus portions of the tail end $Y_{1b}$ and the leading end $Y_{2a}$ are automatically sucked into the yarn holder 14 and discarded. At this time, the transfer tail Yt becomes loose to a great extent due to loss of the tension induced by the yarn holder 14 and its position becomes unstable. In view of this point, if air is jetted downwards by utilizing the nozzle tip 21a of the yarn guide 21 on the preliminary feeder $Y_2$ side prior to the operation of the knotter 11, not only a surplus portion of the transfer tail Yt is cut by the knotter 11 but also at the same time the looseness thereof is absorbed in a downwardly suspended form on the preliminary feeder $Y_2$ side in front of the guide unit 20 (as indicated by a dot-dash line in FIG. 4), then the transfer tail Yt moves rectilinearly across between the yarn guides 21, 21 and the stopper spring 24 and is bent by the lug 26a on the preliminary feeder $Y_2$ side projecting from the base member 26, whereby the transfer tail can be allowed to stand by in a predetermined stand-by posture. In this connection, it is assumed that after the knotter 11 cuts off the surplus portion, the transfer tail Yt can leave the knotter 11 freely.

Figure 5:
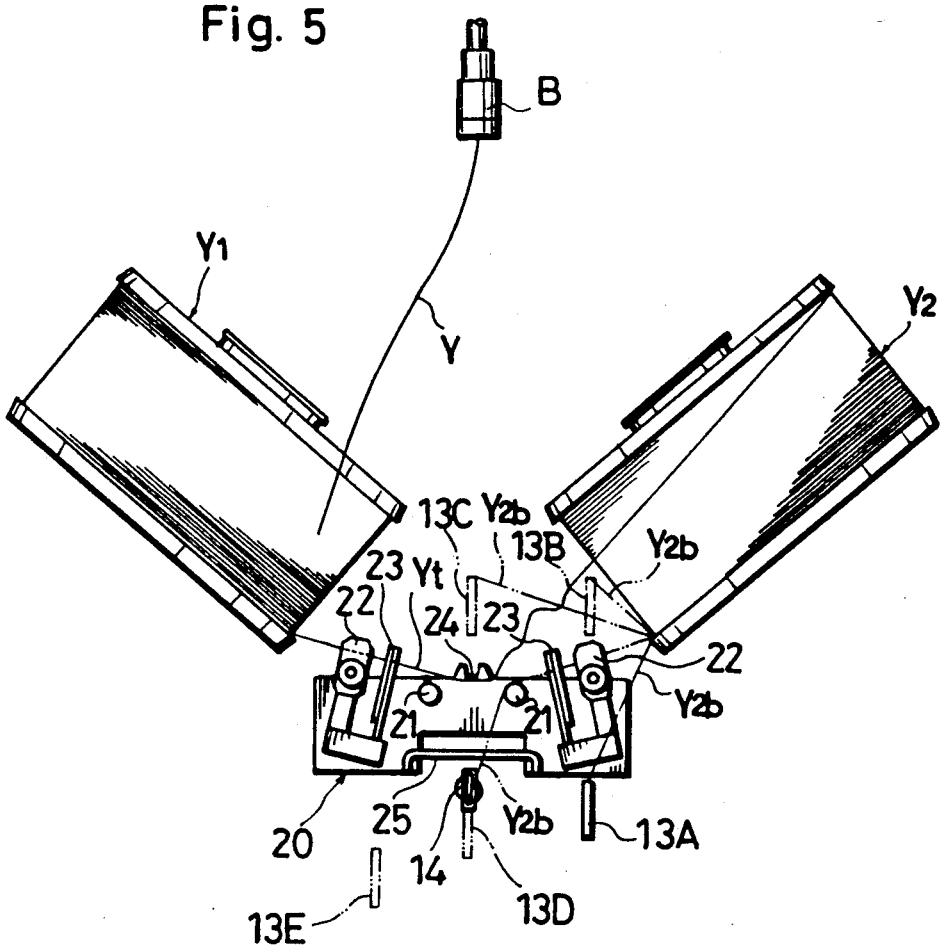
FIG. 5 is an explanatory view showing a different state of operation in the embodiment of FIG. 1.

If the yarn end carrier 13 associated with the tail end $Y_{2b}$ is moved along the previous movement path (the path from the position 13A to position 13E in FIG. 5) of the yarn end carrier 12 and the tail end is sucked in by the yarn holder 14, that tail end $Y_{2b}$ can be positioned and held, like the leading head $Y_{2a}$ in a position among the preliminary feeder $Y_2$-side yarn guide 21, guide member 25 and yarn holder 14. In this case, the position of the tail end $Y_{2b}$ relative to the preliminary feeder $Y_2$ is set in advance so as to pass through the clamper 22 and the cutter 23 between the preliminary feeder $Y_2$ and the yarn guide 21. Thereafter, the yarn end carrier 13 moves to the stand-by position 13 which is symmetric with respect to the initial stand-by position of the yarn end carrier 12 (see FIG. 2) in preparation for the yarn end processing operation for the preliminary feeder to be next loaded to the position of the feeder now in use $Y_1$.

When in this state the whole quantity of the weft on the feeder now in use $Y_1$ has been consumed, the supply source of the weft Y shifts to the preliminary feeder $Y_2$ automatically through the transfer tail Yt, and subsequently the preliminary feeder $Y_2$ is loaded to the position of the feeder now in use, thus permitting the weaving operation to be continued. At this time, although the transfer tail Yt is held by the clamper 22 on the side of the consumed feeder now in use $Y_1$, it can leave the clamper 22 without any trouble because the clamper is opened forwards. Further, the transfer tail Yt must get over the stopper spring 24 in the raised position from the rear to the front side. But, since the stopper spring 24 is curved forward, there will occur no special trouble if only the height and flexibility of the stopper spring are set appropriately.

The feeder now in use $Y_1$ which has been consumed so is now empty is removed and a new preliminary feeder is loaded to the position of the feeder $Y_1$, followed by repetition of the same operation as above. In this case, however, the yarn end carriers 12 and 13 take charge of functions reverse to those in the yarn end processing operation for the previous preliminary feeder $Y_2$. That is, the yarn end carriers 12 and 13 process the tail end and the leading end, respectively, and it goes without saying that their moving paths are quite symmetric with respect to those shown in FIGS. 2 and 5. The foregoing positioning of the tail end $Y_{1b}$ of the feeder now in use $Y_1$ has been performed with the yarn end carrier 12 by a procedure just the same as the foregoing procedure upon loading of a preliminary feeder for the feeder now in use $Y_1$ onto the feeder stand YS.

Figure 3:
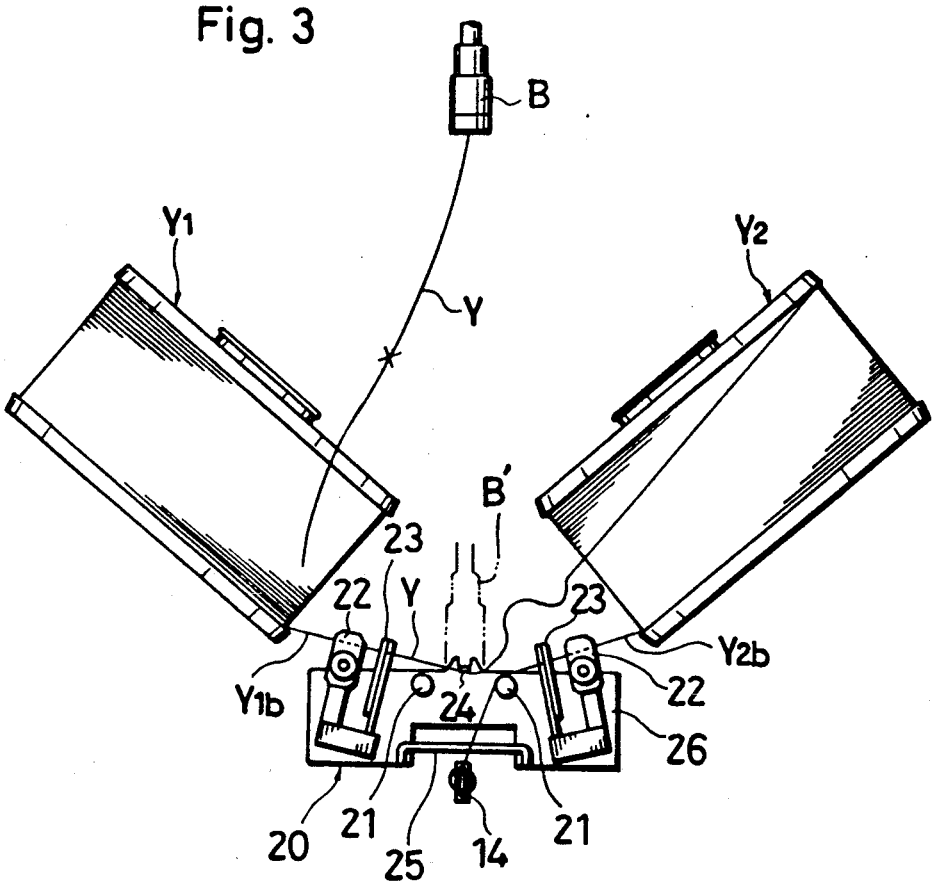
Figure 4:
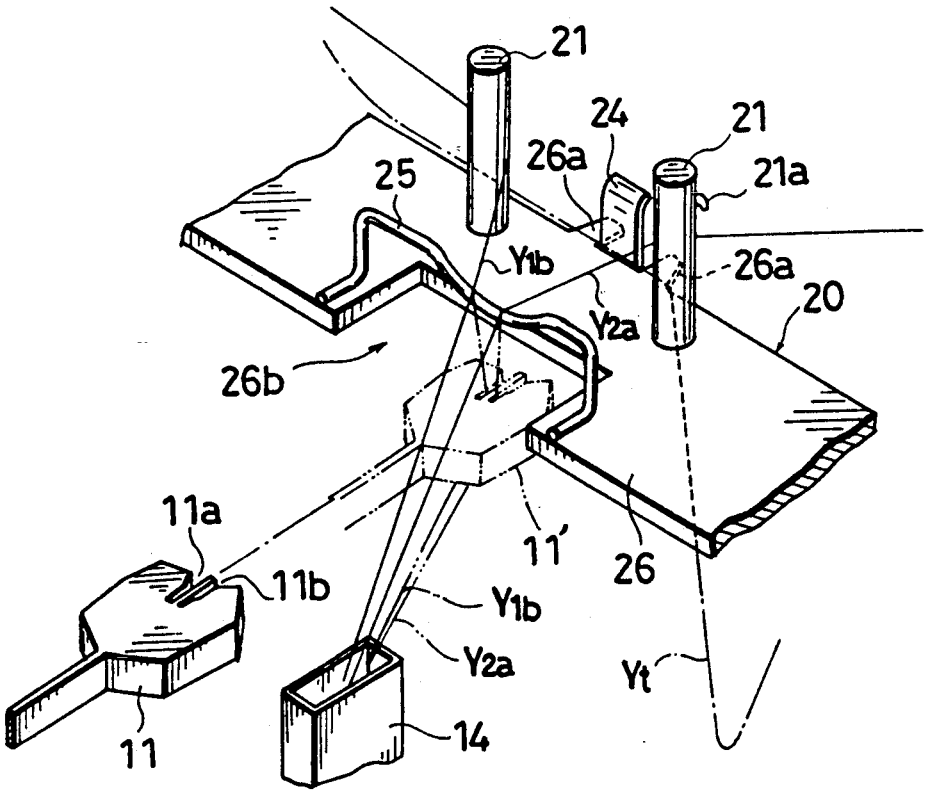
FIG. 4 is an explanatory perspective view of a principal portion of FIG. 1.

On the other hand, in the event of breakage of the weft Y in an intermediate position on the feeder now in use $Y_1$, the operation of the weaving machine is stopped and the guide member B of the automatic threading apparatus is advanced until it is substantially in contact with the guide unit 20, as indicated by a chain line in FIG. 3. Subsequently, the stopper spring 24 is brought down and the cutter 23 on the side of the feeder now in use $Y_1$ is operated to cut the transfer tail Yt, while the operation of the guide member B for suction is started. As a result, the transfer tail Yt on the preliminary feeder $Y_2$ side can undergo threading up to the weft measuring as storing apparatus of the weaving machine and so the weaving operation can be continued using the preliminary feeder $Y_2$ as the feeder now in use. At this time, from the feeder $Y_1$ the use of which has been discontinued because of breakage of the weft Y there remains a short tail end $Y_{1b}$, but there is no fear of the tail end $Y_{1b}$ being sucked in by the guide member B since it is held by the feeder $Y_1$-side clamper 22. The feeder $Y_1$ the use of which has been discontinued is replaced with a new one by the same procedure as above, and a transfer tail Yt is formed between it and the new feeder, then assuming a stand-by state.

In the above description, the yarn guides 21, 21 and the yarn holder 14 constitute a positioning means for the tail end $Y_{1b}$ of the feeder now in use $Y_1$ and the leading end $Y_{2a}$ of the preliminary feeder $Y_2$ in order to arrange and position the tail end $Y_{1b}$ and the leading end $Y_{2a}$ in the operating position of the knotter 11 and in a predetermined shape. The nozzle tips 21*a*, 21*a* of the yarn guides 21, 21 serve as stand-by means for holding the transfer tail Yt in a predetermined stand-by position.

Figure 6:
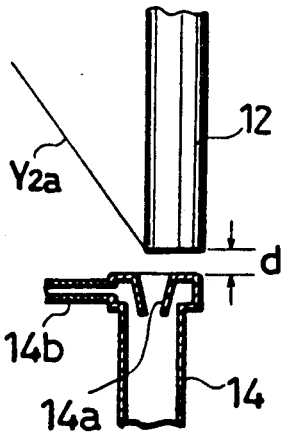
FIG. 6 is an explanatory sectional view of a principal portion, showing another example of a yarn holder used in the present invention.

The clampers 22, 22 are for clamping the tail end $Y_{1b}$ of the weft Y-cut feeder $Y_1$ when the transfer tail Yt is cut by the cutters 23, 23. Therefore, if the positions of the cutters 23, 23 are selected so that the tail end $Y_{1b}$ after cutting is sufficiently short, it is possible to omit the clampers 22, 22. The yarn holder 14 may be of an ejector type as shown in FIG. 6. More specifically, if a constriction 14*a* is formed in an open end of the yarn holder 14 and compressed air is introduced through a pipe 14*b*, there can be generated a high-speed current of air for suction, so even when a relative distance d between the yarn holder 14 and the yarn end carrier 12 which holds the leading end $Y_{2a}$ is somewhat large, the leading end $Y_{2a}$ can be shifted surely from the yarn end carrier 12 to the yarn holder 14. Further, the processing of a surplus portion of the transfer tail Yt which has been cut is also easy. The yarn holder 14 may be a mechanical clamper of a desired type if only the delivery and reception of yarn can be done surely with respect to the yarn end carriers 12, 13.

Figure 7:
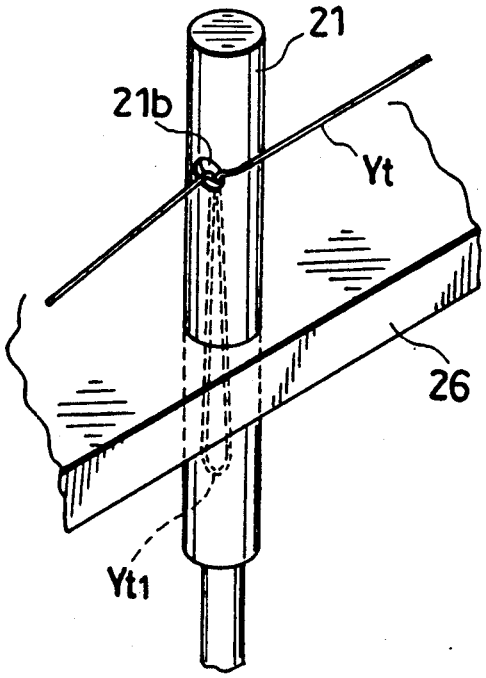
FIG. 7 is a perspective view of a principal portion, showing another example of a yarn guide used in the present invention.

The nozzle tip 21*a* attached to the yarn guide 21 constitutes a stand-by means for adjusting the looseness of the transfer tail Yt into a predetermined stand-by posture, so it may be replaced with an independent air nozzle separately from the yarn guide 21. As shown in FIG. 7, a suction hole 21*b* capable of sucking in a loop shape the loose portion indicated by $Y_{f1}$ of the transfer tail Yt may be formed in the yarn guide 21, whereby the same function can be attained. In this case, since the transfer tail Yt can be brought to its final position accurately, it is possible to omit the stopper spring 24 and the lugs 26*a*, 26*a*.

When there is used a conveyance robot which automatically conveys the preliminary feeder $Y_2$ to the position of a feeder stand YS and loads it onto the stand YS, the yarn end carriers 12 and 13 may be mounted on this conveyance robot and the leading end $Y_{2a}$ and tail end $Y_{2b}$ of the preliminary feeder $Y_2$ may be thereby sucked in and held in advance.

Figure 8:
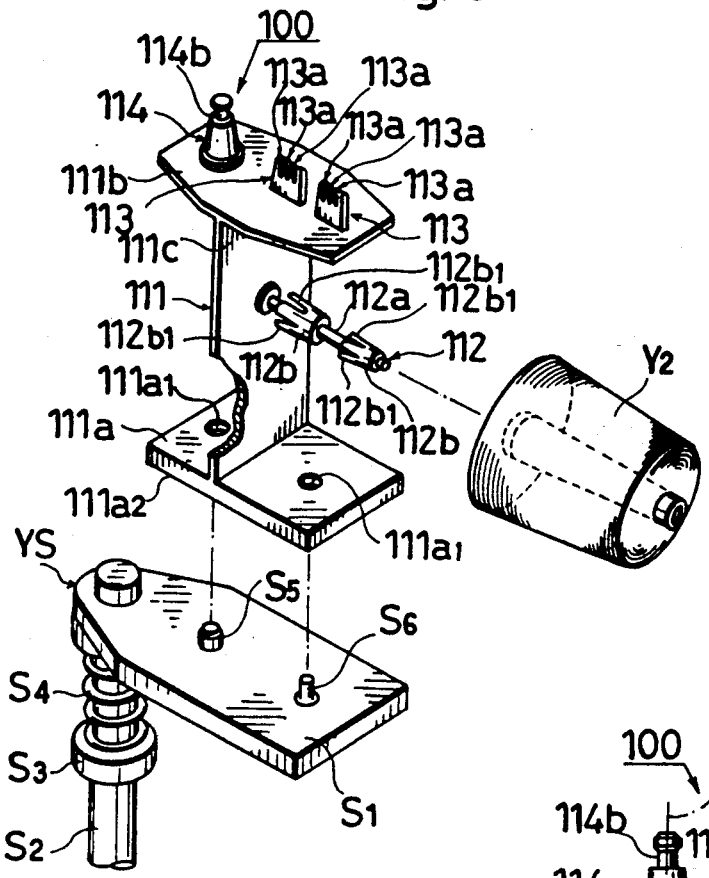
FIG. 8 is an explanatory, entire perspective view showing an example of a feeder conveying cassette used in the present invention.
Figure 9:
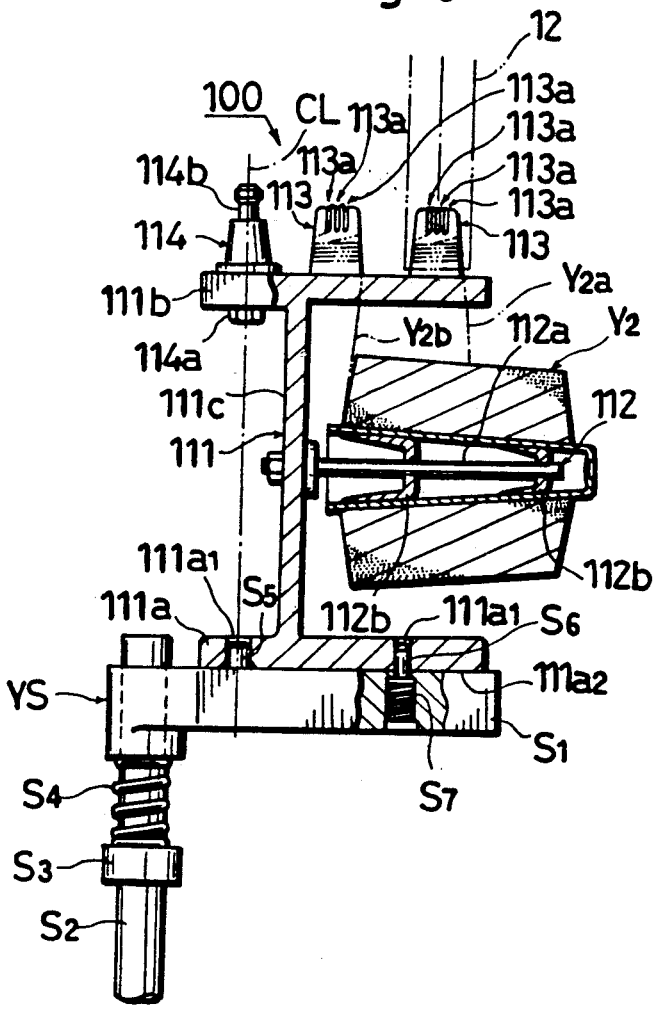
FIG. 9 is an explanatory sectional view showing the whole of the cassette in an assembled state.

FIG. 8 shows a feeder $Y_2$ and a conveyance cassette 100 for drawing out yarn ends $Y_{2a}$ and $Y_{2b}$ of the said feeder, to which is applied the above-mentioned conveyance robot.

The conveyance cassette 100 for the weft feeder comprises a base member 111 as well as a bobbin holder 112, a pair of yarn end fixing members 113, 113 and a grip member 114 which are provided in predetermined positions with respect to the base member 111.

The base member 111 comprises a base plate 111*a* having through holes 111*a*$_1$, 111*a*$_1$, an upper plate 111*b* opposed to the base plate 111*a*, and a connection plate 111*c* which connect the base plate 111*a* and the upper plate 111*b* with each other. An underside 111*a*$_2$ of the base plate 111*a* is used as a mounting face onto the feeder stand YS.

The bobbin holder 112 is provided with a center rod 112*a* and cone holders 112*b*, 112*b*, and is fixed sideways to a substantially central part of the connection plate 111*c*. The cone holders 112*b*, 112*b*, which are formed of a soft plastic material for example, are tapered, large and smaller members which are divergent and open toward the base end side of the center rod 112*a*. They are mounted on the center rod 112*a* in intermediate and front end positions, respectively, in a rotation-prevented state. Each cone holder 112*b* is formed with notches 112*b*$_1$, . . . , whereby the feeder $Y_2$ can be mounted and removed easily with respect to the bobbin holder 112, and the feeder $Y_2$ cone loaded is presented from coming off the bobbin holder.

The yarn end fixing members 113, 113 are chevron-shaped members arranged side by side on the upper surface of the upper plate 111*b* and they each have slits 113*a*, . . . which are open upwards. The leading end $Y_{2a}$ and tail end $Y_{2b}$ of the feeder $Y_2$ loaded on the bobbin holder 112 are wound several times round tapered peripheral walls of the yarn end fixing members 113 and 113, respectively, and their front end portions are bent and inserted into the slits 113*a*, 113*a*, whereby the yarn ends are fixed temporarily fixed. Since these yarn ends are free ends, they can be easily unwound and removed from the yarn end fixing members 113, for example, by pulling them up.

The grip member 114 is formed substantially in a truncated cone shape and is fixed to the upper surface of the upper plate 111*b* through a bolt member 114*a*. The grip member 114 has a neck portion 114*b* of a smaller diameter formed in an upper position. For example, a conveyance robot T shown in FIG. 10 clamps the grip member 114, whereby the whole of the conveyance cassette 100 can be conveyed. For such a clamping mechanism there can be utilized, for example, the tool changer in a machining center. The grip member 114 is disposed so that the axis thereof, indicated at CL, passes through the center of one through hole 111*a*$_1$ of the base plate 111*a*. This is convenient for positioning and loading the conveyance cassette 100 onto the feeder stand YS, as will be described later.

The feeder stand YS of the weaving machine for mounting the conveyance cassette 100 thereon comprises a table $S_1$ and a stand rod $S_2$ which supports the table $S_1$ vertically movably. Further, a spring member $S_4$ for urging the table $S_1$ upwards is interposed between a collar $S_3$ fixed onto the stand rod $S_2$ and the table $S_1$. Between the table $S_1$ and the stand rod $S_2$ is disposed a key or the like (not shown) to permit only vertical movements of the table $S_1$.

The table $S_1$ has a smooth upper surface, from which there project a fixed pin $S_5$ and a movable pin $S_6$ both engageable with and disengageable from the through holes 111*a*$_1$, 111*a*$_1$ of the base plate 111*a*. By fitting these pins and through holes together the conveyance cassette 100 can be positioned and loaded to a predetermined position with respect to the feeder stand YS. The movable pin $S_6$ is urged upwards by a compression spring $S_7$ mounted on the base end portion thereof, while the front end portion of the movable pin $S_6$ is retracted completely from the upper surface of the table $S_1$ when the compression spring $S_7$ is pressed down.

Figure 10:
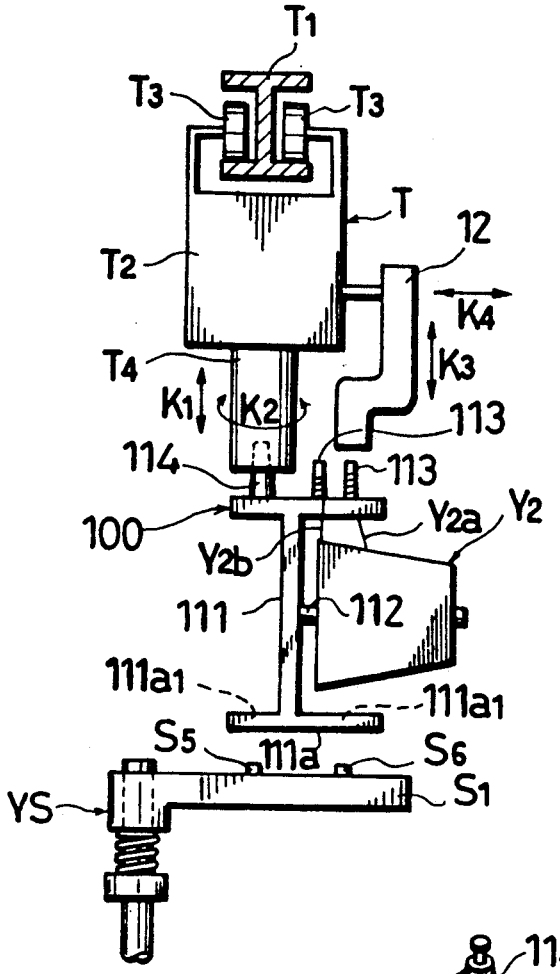
FIG. 10 is a view explanatory of a state of use of the cassette illustrated in FIG. 10.

With the feeder $Y_2$ mounted to the feeder cassette 100 as in FIG. 10, the conveyance robot T can convey the cassette 100 from a stock yard (not shown) up to the weaving machine and then load it onto the feeder stand YS. The conveyance robot T can be constituted by combining a rail member $T_1$ mounted between the weaving machine and the stock yard with a robot body $T_2$ having driving rollers $T_3$, $T_3$ which roll on the rail member $T_1$. The robot body $T_2$ is provided with an arm $T_4$ for clamping the grip member 114 and a yarn end carrier 12 for disengaging the temporarily-fixed yarn ends from the yarn end fixing members 113, 113 and holding them. The conveyance robot T operates in accordance with a control provided from a controller (not shown). The robot body $T_2$ moves along the rail member $T_1$, the arm $T_4$ moves vertically and rotates the directions of arrows $K_1$, $K_2$, and the yarn end carrier 12 moves vertically and horizontally in the directions of arrows $K_3$, $K_4$, to form a transfer tail as described previously.

After the feeder $Y_2$ is loaded onto the bobbin holder 112 of an empty conveyance cassette 100 and the leading end $Y_{2a}$ and tail end $Y_{2b}$ of the feeder $Y_2$ are temporarily fixed to the yarn end fixing members 113, 113, the cassette 100 is stored in the stock yard.

Then, in accordance with a feeder request signal provided from the weaving machine the conveyance robot T clamps the grip member 114 and conveys the cassette 100 from the stock yard up to the position above a first temporary stand (not shown) disposed near the feeder stand YS of the weaving machine, then places it on the first temporary stand.

Subsequently, the conveyance robot T removes the conveyance cassette 100 from the feeder stand YS on the side where the feed for weft has been completed, and places it on a second temporary stand (not shown). Thereafter, the robot T grips the cassette 100 on the first temporary stand and conveys it up to the position above the feeder stand YS, then the arm $T_4$ is brought down, allowing the fixed pin $S_5$ to be fitted in the through hole 111*a* of the base plate 111*a*. At this time, if the other through hole 111*a* and the movable pin $S_6$ are not opposed exactly to each other, both are brought into exact fitting by slightly rotating the arm $T_4$ transversely. Whether this has been done or not can be checked by detecting an upward movement of the movable pin $S_6$ or a change in the rotating torque of a rotary chuck incorporated in the arm $T_4$. Or a torque limiter for limiting the rotating torque of the rotary chuck may be provided to prevent further rotation of the same chuck once the exact pin-hole fitting is made.

In this way the conveyance cassette 100 is positioned and loaded in a predetermined position with respect to the feeder stand YS and hence the leading end $Y_{2a}$ and tail end $Y_{2b}$ which are temporarily fixed to the yarn end fixing member 113, 113 can be positioned to assume predetermined positions.

Further, the yarn end carrier 12 disengages the temporarily-fixed leading end $Y_{2a}$ from the yarn end fixing member 113 and conveys it to the position of the transfer tail, whereby it is possible to make a shift to the transfer tail forming operation. For example, the yarn end carrier 12 is formed as a suction pipe of a shape in which the front end portion is fitted over each yarn end fixing member 113. In this case, by the suction of air from above in the fitted state of the suction pipe over the yarn end fixing member 113 the leading end $Y_{2a}$ can be easily disengaged from the yarn end fixing member 113 and be held.

Figure 11:
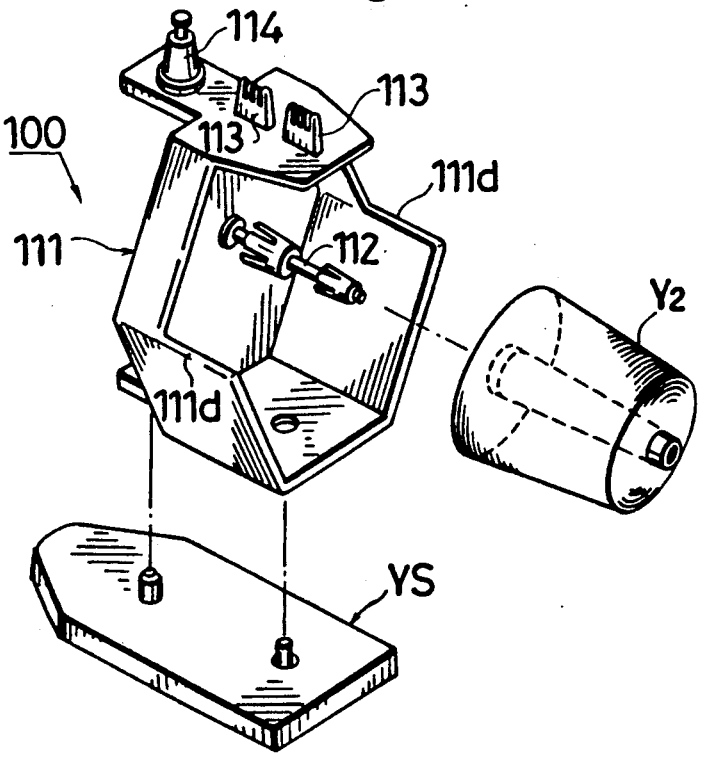
FIG. 11 is an explanatory perspective view showing another example of a feeder conveying cassette used in the present invention.

By loading the feeder $Y_2$ integrally to the feeder cassette 100, the conveyance work using the conveyance robot T and the loading work for the feeder stand YS can be done always in the same manner irrespective of the shape and size of the feeder. In other words, the object to be subjected to such operations can be changed from the feeder Y containing many uncertain elements and containing the yarn ends to the feeder cassette 100 which is constant in shape, so it is possible to facilitate the automation of these operations. In connection with the base member 111 of the conveyance cassette 100, as shown in FIG. 11, yarn guides 111*d*, 111*d* may be formed on both sides of the bobbin holder 112. These yarn guides are employable as guides when the leading end $Y_{2a}$ and tail end $Y_{2b}$ fixed temporarily to the yarn end fixing members 113, 113 are drawn out from the feeder $Y_2$, whereby the yarn ends can be drawn out smoothly.

Figure 12:
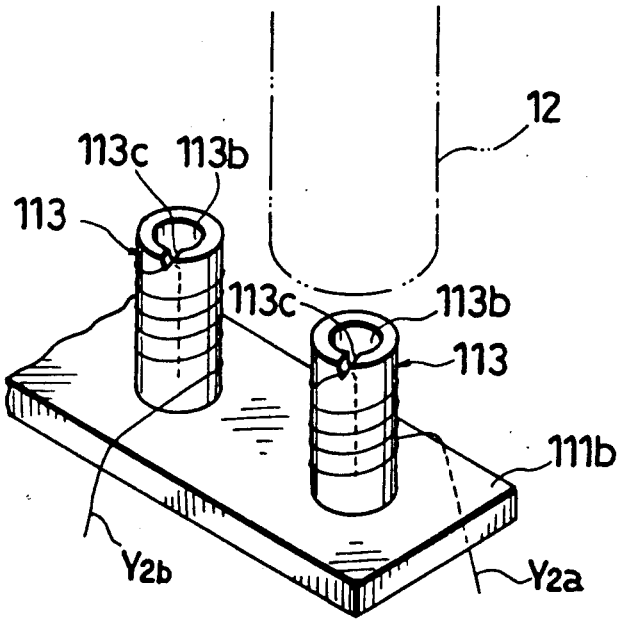
FIG. 12 is an explanatory view showing another example of a yarn end fixing member for the feeder conveying cassette used in the present invention.

The yarn end fixing members 113, 113 may be constituted by cylinders having hollow portions 113*b*, 113*b*, as shown in FIG. 12. In this case, the yarn ends are wound round the peripheral walls of the cylinders, then bent and temporarily fixed so that the front end portions thereof are suspended long through the hollow portions 113*b*, 113*b*, whereby the yarn end releasing operation of the yarn end carrier 12 can be done more smoothly because at the time of suction there is created a strong suction current in the hollow portions 113*b*, 113*b*. Although in FIG. 12 a V-shaped yarn end holding slit 113*c* is formed in the upper portion of each yarn end fixing member 113, the slit 113*c* is not always necessary.

Figure 13:
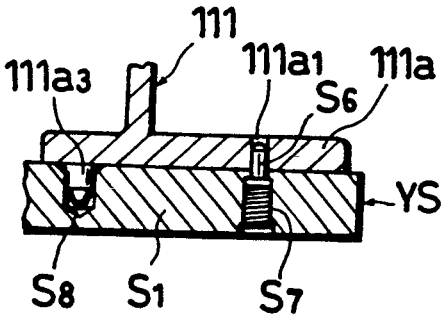
FIG. 13 is an explanatory sectional view showing another example of a base plate of the feeder conveying cassette used in the present invention.

Further, in place of forming the through hole 111*a*$_1$ in the base plate 111*a* of the base member 111, a pin 111*a*$_3$ may be projected downwards from the base plate, as shown in FIG. 13. In this case, a concave portion $S_8$ is formed, in place of the fixed pin $S_5$, in the upper surface of the table $S_1$ of the feeder stand YS. Thus, as long as the base member 111 can be easily mounted in a predetermined position with respect to the feeder stand YS, suitable positioning means may be formed on both the base member and the feeder stand and then combined together.

Of course, in the above embodiment, the shapes and mounting positions of the bobbin holder 112, yarn end fixing members 113, 113 and grip member 114 may be changed to other known ones than those illustrated in the drawings provided that they can easily engage and disengage the feeder $Y_2$, fix the yarn ends temporarily and release them where required, and can be easily clamped by the conveyance robot T, respectively. In the use of the conveyance cassette described above, by temporarily fixing the yarn ends of the feeder to the yarn end fixing members fixed to the base member it is possible to fix a relative positional relation between the base member and the yarn ends, so useless motions of the yarn ends of the feeder during conveyance can be eliminated. Moreover, by merely positioning and loading the base member with respect to a feeder stand it is possible to fix the yarn ends to predetermined positions in a certain posture. Besides, where required, it is possible to release the yarn ends easily. For example, therefore, in automating the transfer tail forming operation, the automating apparatus can be extremely simplified.

The yarn end carrier 12 alone may be used in temporarily fixing the yarn ends to the yarn end fixing members 113, 113, and when a new preliminary feeder $Y_2$ has been loaded onto the feeder stand YS, the tail end $Y_{1b}$ of the feeder now in use $Y_1$ and the leading end $Y_{2a}$ of the preliminary feeder $Y_2$ may be conveyed together to form a transfer tail Yt. More specifically, first either the tail end $Y_{1b}$ or the leading end $Y_{2a}$ is held by suction with the yarn end carrier 12, then the other is held by suction, and thereafter, like the embodiment illustrated in FIG. 2, the yarn end carrier 12 is passed between the yarn guides 21, 21 and is brought down behind the guide unit 20, whereby the tail end $Y_{1b}$ and the leading end $Y_{2a}$ can be positioned simultaneously among the lower end of the yarn end carrier 12, guide member 25 and yarn guides 21, 21. In this state, if the knotter 11 is advanced toward the tail end $Y_{1b}$ and the leading end $Y_{2a}$ in a suitable direction not interfering with the yarn end carrier 12 which is in a descended state, there can be formed a transfer tail Yt in the same manner as above. Also during the operation of the knotter 11, the tail end $Y_{1b}$ and the leading end $Y_{2a}$ are held by the yarn end carrier 12, the yarn holder 14 is not necessary. But it goes without saying that even in this case the tail end $Y_{1b}$ and the leading end $Y_{2a}$ may be transferred from the yarn end carrier 12 to the yarn holder 14, using the latter, and thereafter the knotter 11 may be operated.

According to the transfer tail forming apparatus of the present invention, as set forth hereinabove, the tail end of the feeder now in use and the leading end of the preliminary feeder are positioned in the knotter operating position by the positioning means, and the transfer tail formed by the knotter is held in a predetermined stand-by posture. Consequently, the transfer tail for connection of the feeder now in use with the preliminary feeder can be formed automatically. Accordingly, not only the burden in the working of the weaver can be lightened, but also in constructing a complete automation system for the feeder conveying and replacing works, it is possible to greatly improve the utility of the same system.

What is claimed is:

1. A transfer tail forming apparatus for changing a yarn supply to a loom without interrupting a continuous operation of the loom, said transfer tail forming apparatus comprising:

a positioning means for automatically arranging and positioning a tail end of yarn on a feeder now in use and a leading end of yarn on a preliminary feeder to a knotter operating position for connection together by a knotter; and a stand-by means for holding in tension a transfer tail formed by said knotter in a predetermined stand-by posture;

while a leading end of yarn is continuously fed from said feeder now in use to said loom while said transfer tail is held in said predetermined stand-by posture while said loom is operating.

2. A transfer tail forming apparatus according to claim 1, wherein said positioning means includes a yarn end carrier for holding said tail end or said leading end releasably, means for moving said yarn end carrier horizontally and vertically, and a yarn guide and a yarn holder both opposed to a guide member of an automatic threading apparatus for holding said tail end and said leading end in the knotter operating position.

3. A transfer tail forming apparatus according to claim 1, wherein said positioning means includes a yarn end carrier for holding said tail end and said leading end together, means for moving said yarn end carrier horizontally and vertically, and said positioning means also including a yarn guide for holding said tail end and said leading end in the knotter operating position between said yarn guide and said yarn end carrier.

4. A transfer tail forming apparatus according to either claim 2 or claim 3, wherein said yarn end carrier has a suction nozzle formed therein, and a net for stopping the suction of a yarn end is disposed in the interior of said suction nozzle.

5. A transfer tail forming apparatus according to claim 2, wherein said yarn holder has an upward suction nozzle formed therein, and a pair of said yarn guides are disposed symmetrically above said yarn holder.

6. A transfer tail forming apparatus according to either claim 2 or claim 3, wherein at least a tail end cutter is disposed between said yarn guide and said feeder now in use, and a clamp for clamping a yarn end releasably is disposed between said yarn guide and said preliminary feeder.

7. A transfer tail forming apparatus according to claim 1, wherein said stand-by means includes a yarn guide with a nozzle tip attached thereto, said nozzle tip providing a jet to prevent loosening of said transfer tail, said stand-by means also including a stopper spring for positioning the transfer tail to a position which faces a guide member.

8. A transfer tail forming apparatus according to claim 1, wherein said stand-by means includes a yarn guide having a suction hole formed therein to suck in said transfer tail to prevent loosening of the transfer tail.

9. A transfer tail forming apparatus, wherein a tail end of yarn on a feeder now in use and a leading end of yarn on a preliminary feeder are connected together by means of a knotter, said transfer tail forming apparatus including a positioning means for arranging and positioning said tail end and said leading end to a knotter operating position, and a stand-by means for holding a transfer tail formed by said knotter in a predetermined stand-by posture, and a conveyance cassette having means for removably mounting a feeder and means for conveying said feeder onto a feeder stand of a weaving machine, said conveyance cassette having a yarn end fixing member for fixing said tail end and said leading end temporarily.

10. A transfer tail forming apparatus according to claim 9, wherein said conveyance cassette is formed in a connected shape of a base plate and an upper plate through a connection plate, and a feeder loading bobbin holder is attached to said connection plate, said upper plate having a grip member for conveyance provided projectingly thereon, and wherein said yarn end fixing member also is provided projectingly on said upper plate for temporarily fixing said tail end and said leading end.

11. A transfer tail forming apparatus according to claim 10, wherein a through hole for engagement with a fixed pin formed on the feeder stand is formed in said base plate in a position corresponding to the axis of said grip member, and another through hole is formed in the underside of said base plate.

12. A transfer tail forming apparatus according to claim 10, wherein a pin for engagement with a concave portion formed in the feeder stand is formed on said base plate in a position corresponding to the axis of said grip member, and another through hole is formed in the underside of said base plate.

13. A transfer tail forming apparatus according to claim 10, wherein said yarn end fixing member is constituted by a chevron-shaped member having slits formed vertically in an upper portion thereof.

14. A transfer tail forming apparatus according to claim 10, wherein said yarn end fixing member is constituted by a hollow cylinder.

15. A transfer tail forming apparatus according to claim 10, wherein said connection plate comprises two side portions and wherein guides for drawing out said leading end or said tail end smoothly are provided on each of said side portions of said connection plate.

16. A transfer tail forming apparatus according to claim 9, wherein said positioning means includes a yarn end carrier for holding said tail end or said leading end releasably, means for moving said yarn end carrier horizontally and vertically, and a yarn guide and a yarn holder both opposed to a guide member of an automatic threading apparatus for holding said tail end and said leading end in the knotter operating position.

17. A transfer tail forming apparatus according to claim 9, wherein said positioning means includes a yarn end carrier for holding said tail end and said leading end releasably, means for moving said yarn end carrier horizontally and vertically, and a yarn guide for holding said tail end and said leading end in the knotter operating position between said yarn guide and said yarn end carrier.

18. A transfer tail forming apparatus according to either claim 16 or claim 17, wherein said yarn end carrier has a suction nozzle formed therein, and a net for stopping the suction of a yarn end is disposed in the interior of said suction nozzle.

19. A transfer tail forming apparatus according to claim 16, wherein said yarn holder has an upward suction nozzle formed therein, and a pair of said yarn guides are disposed symmetrically above said yarn holder.

20. A transfer tail forming apparatus according to either claim 16 or claim 17, wherein a tail end cutter is disposed between said yarn guide and said feeder now in use, and a clamp for clamping a yarn end releasably is disposed between said yarn guide and said preliminary feeder.

21. A transfer tail forming apparatus according to claim 9, wherein said stand-by means includes a yarn guide with a nozzle tip attached thereto, said nozzle tip providing a jet to prevent loosening of said transfer tail, and also includes a stopper spring for positioning the transfer tail to a position which faces a guide member.

22. A transfer tail forming apparatus according to claim 9, wherein said stand-by means includes a yarn guide having a suction hole formed therein to suck in said transfer tail to prevent loosening of the transfer tail.

23. A transfer tail forming apparatus according to claim 1, wherein said stand-by means includes a clamp for releasably clamping said transfer tail.

24. A transfer tail forming apparatus for changing a yarn supply to a loom without interrupting a continuous operation of the loom, said transfer tail forming apparatus comprising:

a positioning means for automatically arranging and positioning a tail end of yarn on a feeder now in use and a leading end of yarn on a preliminary feeder to a knotter operating position for connection together by a knotter;

a stand-by means for holding in tension a transfer tail formed by said knotter in a predetermined stand-by posture; and means for continuously feeding a leading end of yarn from said feeder now in use to said loom while said transfer tail is held in said predetermined stand-by posture.

* * * * *